US006273416B1

(12) United States Patent
Watanabe et al.

(10) Patent No.: US 6,273,416 B1
(45) Date of Patent: Aug. 14, 2001

(54) SHEET FEEDING UNIT AND METHOD, AND IMAGE READER

(75) Inventors: Hirotake Watanabe; Tamio Amagai, both of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/489,946

(22) Filed: Jan. 24, 2000

(30) Foreign Application Priority Data

Aug. 20, 1999 (JP) ..... 11-233935

(51) Int. Cl.[7] ..... B65H 3/52
(52) U.S. Cl. ..... 271/121; 271/124; 271/167
(58) Field of Search ..... 271/121, 124, 271/167, 10.09, 10.11

(56) References Cited

U.S. PATENT DOCUMENTS

| | | | | |
|---|---|---|---|---|
| 5,435,537 | | 7/1995 | Gysling . | |
| 5,527,029 | * | 6/1996 | Bortolotti et al. | 271/124 |
| 5,622,364 | | 4/1997 | Dutton et al. . | |
| 5,879,003 | * | 3/1999 | Kovach et al. | 271/167 X |
| 5,895,039 | * | 4/1999 | Kato et al. | 271/124 |
| 6,126,161 | * | 10/2000 | Kato | 271/124 X |

FOREIGN PATENT DOCUMENTS

| | | |
|---|---|---|
| 62-191340 | 8/1987 | (JP) . |
| 62-196236 | 8/1987 | (JP) . |
| 8-2722 | 1/1996 | (JP) . |
| 10-72142 | 3/1998 | (JP) . |

OTHER PUBLICATIONS

Patent Abstracts of Japan, Publication No. 56265640A of Dec. 19, 1981.
Patent Abstracts of Japan, Publication No. 61174044A of Aug. 5, 1986.
Patent Abstracts of Japan, Publication No. 62196237A of Aug. 29, 1987.
Patent Abstracts of Japan, Publication No. 03003828A of Jan. 9, 1991.
Patent Abstracts of Japan, Publication No. 04129934A of Apr. 3, 1992.
Patent Abstracts of Japan, Publication No. 05237572A of Sep. 17, 1993.
Patent Abstracts of Japan, Publication No. 05254674A of Oct. 5, 1993.
Patent Abstracts of Japan, Publication No. 06144618A of May 24, 1994.
Patent Abstracts of Japan, Publication No. 07069472A of Apr. 14, 1995.
Patent Abstracts of Japan, Publication No. 09240868A of Sep. 16, 1997.

* cited by examiner

*Primary Examiner*—David H. Bollinger
(74) *Attorney, Agent, or Firm*—Armstrong, Westerman, Hattori, McLeland, & Naughton, LLP

(57) ABSTRACT

The present invention has an object to provide a sheet feeding device and method, and image reader which facilitate setting of a sheet pile, serve to separate and feed a sheet succesfully. The present invention provides a separation gate between draw and separation rollers for achieving a multi-stage separation. The separation gate is made movable in synchronization with the draw roller so as to maintain a certain separation condition, despite of the draw roller that may descend according to the number of piled sheets.

16 Claims, 12 Drawing Sheets

SHEET FEEDING UNIT AND METHOD, AND IMAGE READER

BACKGROUND OF THE INVENTION

The present invention relates generally to sheet feeding units and methods, and image readers, and more particularly to an automatic document feeder ("ADF") which sequentially feeds every one sheet from a pile of sheets, and an automatic sheet feeding method. The sheet feeding device and method according to the present invention are suitable for an ADF in an image reader, such as an image scanner, a copier, and a facsimile machine. Of course, the sheet is not limited to paper, but includes an OHP film and any other sheet material.

A document feeder for use with an image reader may be classified into a manual document feeder ("MDF") that requires a user to place every sheet to be read on a predetermined table, and an ADF that automatically feeds one by one each sheet when a user places one or more sheets to be read on a predetermined table. Unlike the MDF that requires a user to separate each sheet to be read, the ADF should be equipped with separator/feeder means for separating one sheet from a plurality of sheets to be read and for supplying it to the reading part.

A conventional ADF typically includes, as shown in FIG. 18, draw roller 2, separation roller 4, separation pad 6 arranged opposite to the separation roller 4, and tray part 8 opposite to the draw roller 2. Hereupon, FIG. 18 is a sectional view of essential part in the conventional document feeder 1. Plural sheets P are piled up on the tray part 8. The draw roller 2 is rotatable in an arrow direction and movable up and down as illustrated. The draw roller 2 contacts the uppermost sheet P in the pile and feeds one or more top sheets P between the separation roller 4 and the separation pad 6. The separation roller 4 rotates in an arrow direction as illustrated, separates one sheet P, in cooperation with the separation pad 6, and feeds it to the subsequent stage unit.

However, the conventional ADF has several drawbacks. First, left ends of the piled sheets P on the tray part 8, which arc out of alignment as shown in FIG. 18, often cause more than one sheets P to be fed at the same time. Due to the arrangement in which a position of the draw roller 2 is movable up and down according to the number of sheets P on the tray part 8 whereas positions of the separation roller 4 and the separation pad 6 are fixed, a height of the top sheet P in the pile to be introduced to the separation roller 4 differs according to the number of piled sheets P, thereby changing unstably the sheet separation condition according to the height of the sheets P on the tray part 8. In other words, the conventional ADF has a disadvantage in easily causing the double feed and/or jam due to the insufficient separation of sheets P.

BRIEF SUMMARY OF THE INVENTION

Therefore, it is an exemplified general object of the present invention to provide a novel and useful sheet feeding device and method, and image reader in which the above disadvantages are eliminated.

Another exemplified and more specific object of the present invention is to provide a sheet feeding device and method, and image reader that serve to separate a sheet successfully.

In order to achieve the above objects, a sheet feeder comprises a draw roller movably provided so that the draw roller may contact an uppermost sheet in plural sheets, and feeding one sheet or more including the uppermost sheet, and a separation gate provided downstream relative to the draw roller in a sheet feed direction, and movable according to a movement of the draw roller, the separation gate restricting the number of sheets fed by the draw roller. This sheet feeder thus moves the separation gate according to the movement of the draw roller.

A sheet feeder of another aspect of the present invention comprises a draw roller movably provided so that the draw roller may contact an uppermost sheet in a pile of sheets, and feeding one sheet or more including the uppermost sheet, and a separation gate provided downstream relative to the draw roller in a sheet feed direction, and aligning an edge of the pile with a direction approximately perpendicular to the sheet feed direction. The separation gate in this sheet feeder aligns the ends of the piled sheets with a direction approximately perpendicular to the feed direction.

A sheet feeder of still another aspect of the present invention comprises a draw roller provided movably up-and-down so that the draw roller may contact an uppermost sheet in plural sheets, and feeding one sheet or more including the uppermost sheet, a separation roller which separates the uppermost sheet from those fed by the draw roller and feeds the uppermost sheet, a separation pad which cooperates with the separation roller, and a guide part which contacts the sheet fed by the separation roller, and maintains an approach angle of the sheet to the separation roller. The guide part in this sheet feeder maintains sheet's approach angle to the separation roller and prevents a change of the sheet separation condition.

A sheet feeder of another aspect of the present invention comprises a draw roller provided movably up-and-down so that the draw roller may contact an uppermost sheet in plural sheets, and feeding one sheet or more including the uppermost sheet, a separation roller which separates the uppermost sheet from those fed by the draw roller, and feeds the uppermost sheet, a separation pad which cooperates with the separation roller, and a separation gate provided between the draw roller and the separation roller, and restriction the number of sheets fed by the draw roller feeds to the separation roller. This sheet feeder may realize a two-stage sheet separation using the separation gate and the separation roller (together with the separation pad).

A sheet feeding method of another aspect of the present invention comprises the steps of sequentially feeding one or more sheets from a top of piled sheets placed on a table using a draw roller, restricting using a separating gate, the number of sheets to be fed, adjusting a relative configuration between the separation gate and the draw roller, and separating using a separation pad and a separation roller, a sheet out of those fed through the separation gate. This sheet feeding method thus adjusts the relative configuration between the separation gate and the draw roller.

An image reader of another aspect of the present invention comprises one of the above sheet feeders, and a reading part that reads out a sheet fed by the sheet feeder. This image reader may effect the same operation of the above sheet feeders.

Other objects and further features of the present invention will become readily apparent from the following description of the embodiments with reference to accompanying drawings.

DETAILED DESCRIPTION OF INVENTION

Figure 1:
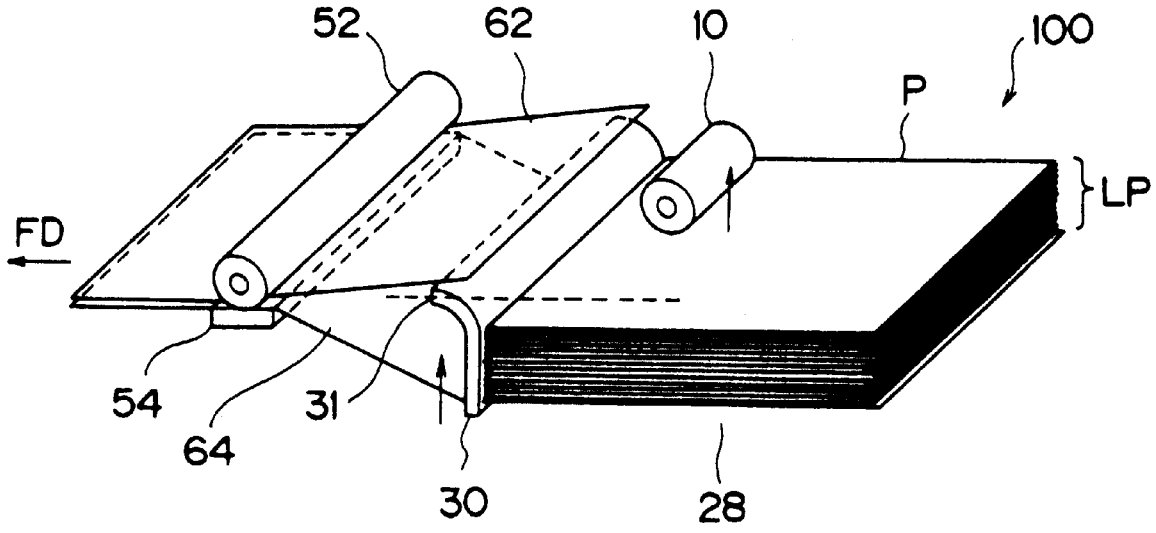
FIG. 1 is a schematic sectional view of a sheet feeder of one embodiment according to the present invention.
Figure 2:
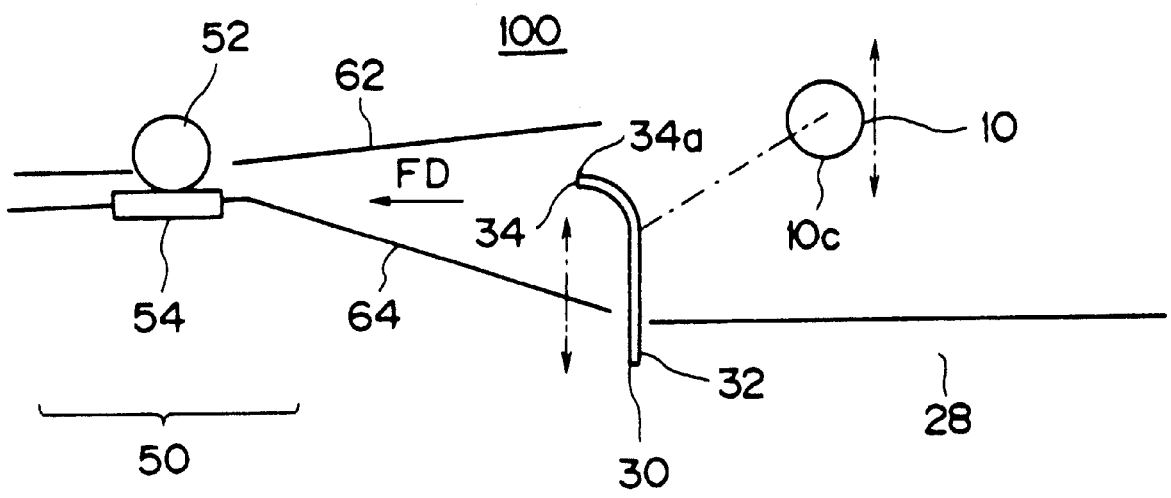
FIG. 2 is a schematic sectional view of the sheet feeder shown in FIG. 1.

A description will now be given of sheet feeder 100 of one embodiment according to the present invention, with reference to the accompanying drawings. Those elements which are designated by the same reference numerals denote the same elements, and a description thereof will be omitted. FIG. 1 is a schematic perspective view of the sheet feeder 100. FIG. 2 is a schematic sectional view of the sheet feeder 100 shown in FIG. 1 (although omitting sheet P). The sheet feeder 100 includes draw roller 10, sheet table 28, separation gate 30, final separation part 50, upper guide 62, and lower guide 64.

The draw roller 10 is up-and-down movable above the sheet table 28 onto which a pile LP of sheets P are placed. An image to be read, for example, is drawn on each sheet P. The draw roller 10 moves up and down before positioned so that it may contact the uppermost sheet P in the pile LP and apply the slight compression force to the pile LP. The up-and-down movement direction does not have to be completely perpendicular to the feed direction FD of the sheet P. For example, the draw roller 10 may be arranged rotatable around an external fulcrum. In feeding a sheet P, the draw roller 10 rotates clockwise in FIGS. 1 and 2, and feeds (one or more) top sheets P in the pile LP to the subsequent stage device. Preferably, the draw roller 10 may be made of rubber etc. having a large friction coefficient enough to separate the top sheets P from the pile LP against the in-sheet friction or electrostatic force in the pile LP.

The separation gate 30 is arranged adjacent to and perpendicular to the sheet table 28 between the draw roller 10 and the final separation part 50. The separation gate 30 includes, as shown in FIG. 2, perpendicular and bent parts 32 and 34. The perpendicular and bent parts 32 and 34 are formed by partially bending one elastic plate member, but may be formed by two independent members in the present invention. As described later, the separation gate 30 may move up and down, and end 31 of the separation gate 30 in FIG. 1 may be fixed or movable. For example, when the separation gate 30 moves up, the end 31 may move in the direction FD.

The perpendicular part 32 stands approximately perpendicular to the feed direction FD, and blocks a sheet P to be fed that contacts it from being fed in the feed direction FD. On the other hand, the bent part 34 is connected to the perpendicular part 32, and bent towards the feed direction FD of the sheet P, allowing the sheet P which contacts it to be led in the feed direction FD along its bent surface. Nevertheless, the bent part 34 may be made of the same material as that of the separation pad 54 which will be described later, so as to capture the lowest sheet P among, a plurality of sheets P, serving as the separation pad 54.

The separation gate 30 includes several functions as described below. Firstly, the separation gate 30 performs a pre-stage separation relative to that of the final separation part 50, providing multistage (two-stage in this embodiment) separations in the sheet feeder 100. The more multistage separations would be realized by providing a plurality of separation gates along the feed path of the sheet P.

The separation gate 30 separates the sheet P by restricting the feed number of sheets P that the draw roller 10 may draw. The limited feed number would be realized by controlling an arrangement between the separation gate 30 and the draw roller 10. Referring to FIG. 2, a relative arrangement (in a height direction) between top part 34*a* in the bent part 34 of the separation gate 30 and bottom part 10*c* in the draw roller 10 is determined in light of a desired sheet separation performance. For example, the top part 34 is set to be level to or preferably slightly higher than the bottom part 10*c* so as to allow one or more sheets P from among piled sheets P on the sheet table 28.

As described above, the perpendicular part 32 blocks the sheet P from moving in the feed direction FD. Therefore, the appropriate arrangement of the perpendicular part 32 would allow the separation gate 30 to feed only one or more top sheets P while blocking the lower sheets P using the perpendicular part 32.

Figure 18:
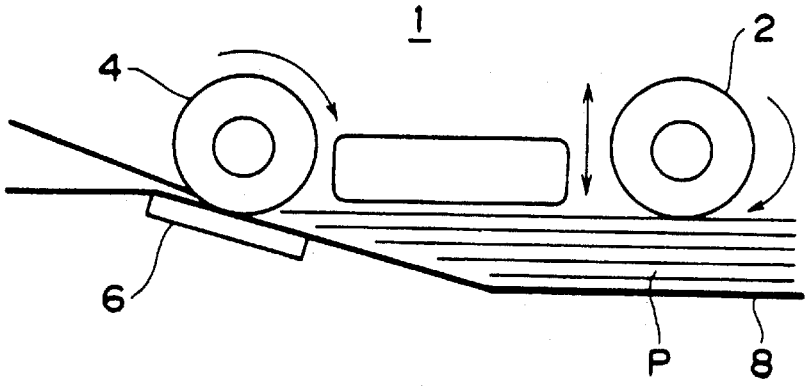
FIG. 18 is an enlarged section of essential part in the conventional sheet feeder.

In the prior art example shown in FIG. 18, the feed force by the draw roller 2 spreads over the entire pile and frequently feeds no sheet P at all or sheets P more than those that the separation roller 4 and the separation pad 6 may handle for separation, causing a jam and double feed. On the contrary, the separation gate 30 in this embodiment separates (or allows to be fed) only one or more sheets P from the top, solving the above problems.

Secondly, the separation gate 30 facilitates a user to set the sheet pile LP on the sheet table 28 and assures the feeding of the sheet. The user sets the sheets P on the sheet table 28 by flushing the end of the pile LP with separation gate 30's perpendicular part 32. In the conventional sheet pile LP slanting scraggly as shown in FIG. 18, a certain sheet P from the top which retreats from the draw roller 2 is not fed. On the other hand, when the user strongly forces the piled sheets P into the inside so as to flush their ends, some sheets P are inserted between the separation roller 4 and the separation pad 6, causing the jam and double feed. On the contrary, the instant embodiment allows a user to flush the pile with the separation gate 30 in setting it, securing the feed by the draw roller 10.

The final separation part 50 includes the separation roller 52 and separation pad 54. The separation roller 52 and pad 54 are made of a resin roller and pad having a large frictional coefficient, and may separate and feed in the feed direction FD one sheet P (that contacts the separation roller 52) when receiving a plurality of sheets P. A weak frictional force between the separation roller 52 and pad 54 would not separate a sheet P, and a strong frictional force would impede the feed of a sheet P. Thus, it is preferable to maintain the sheet feeding relationship of (in-sheet static frictional force) <(separation pad 54's frictional force)< (draw roller 10's sheet feeding, force).

This relationship seems to indicate that the sheet separation force increases by increasing the draw roller 10's sheet feeding force and the separation pad 54's frictional force but the sheet is disadvantageously torn when the actual sheet feeding force of the roller 10 excessively increases. Even the in-paper static frictional force greatly differs according to sheet's nature used for a scanner, printer, etc. Moreover, as a scanner uses various specific papers, such as an NCR, the separation pad 54 is preferably made of materials that cause no chemical action by the pressure. It is often made of EPDM material conventionally.

The upper and lower guides 62 and 64 are provided between the separation gate 30 and the final separation part 50 at upper and lower sides of the feed path, respectively. The upper and lower guides 62 and 64 assist the feeding of and guide the sheet P that has passed the separation gate 30 to the final separation part 50. The upper and lower guides 62 and 64 are made of a metal plate, such as stainless, and may have a rough surface if necessity arises, e.g., to prevent a paper jam effectively.

Figure 3:
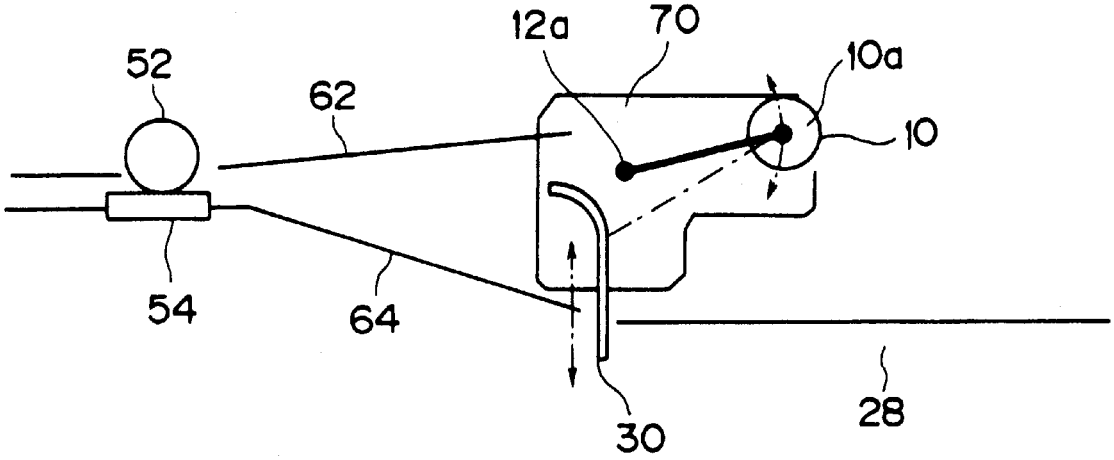
FIG. 3 is a schematic sectional view showing one example of a connection and drive of draw roller and separation rollers in the sheet feeder shown in FIG. 2.
Figure 4:
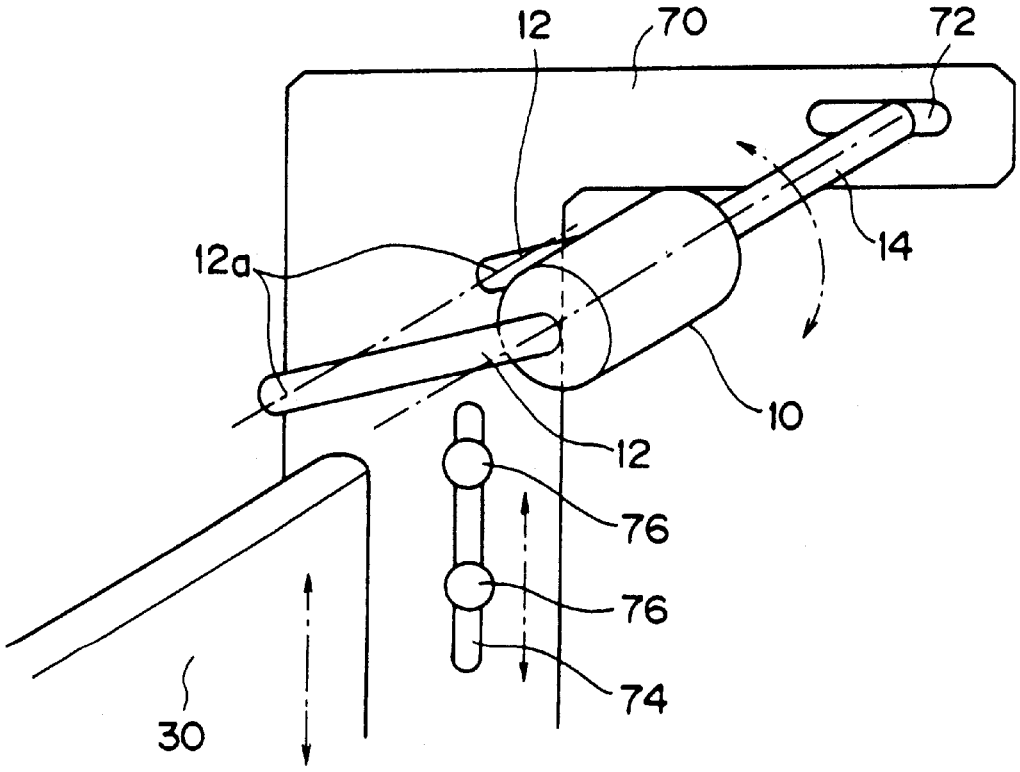
FIG. 4 is a partially enlarged perspective view of essential part of FIG. 3 which shows an example of connection configuration between the draw roller and the separation gate.

A description will now be given of a control over an arrangement of the draw roller 10 and the separation gate 30, with reference to FIGS. 3 though 5. FIG. 3 is a schematic sectional view of an exemplified connection between and drive for the draw roller 10 and the separation roller 30 shown in FIG. 2. FIG. 4 is an enlarged perspective view of essential part of FIG. 3 showing an exemplified connection structure of the draw roller 10 and the separation gate 30.

Referring to FIG. 3, transmission plate 70 links an up-and-down movement of the draw roller 10 to that of the separation gate 30. The draw roller 10 rotates around rotary fulcrum 12*a* within a predetermined range. The transmission plate 70 transmits to the separation gate 30 the rotary amount of the draw roller 10 (an up-and-down movable interval), and consequently the separation gate 30 moves tip and down in synchronization with the movement of the draw roller 10. The sheet table 28, separation roller 52, and separation pad 54 are fixed in FIG. 3. The transmission plate 70 is made of metal, such as stainless, approximately L-shaped, and movable up and down. The transmission plate 70 includes horizontal and perpendicular guide grooves 72 and 74 as shown in FIG. 4. The separation gate 30 is fixed physically onto the transmission plate 70 directly or indirectly. As a result, an up-and-down movement of the transmission plate 70 results in the up-and-movement of the separation gate 30.

Referring to FIG. 4, the draw roller 10 includes a pair of rods 12, and rod 14. The rods 12 each have rotary fulcrum 12*a*, and are connected to both ends 10*a* and 10*b* of the draw roller 10 (although 10*b* is omitted in FIG. 3) Both rods 12 are connected to the shaft (not shown) that penetrates the fulcrum 12*a* so that they may or may not rotate around the shaft. Of course, the present invention may adopt any mechanism for rotating both rods 12 simultaneously.

Figure 5:
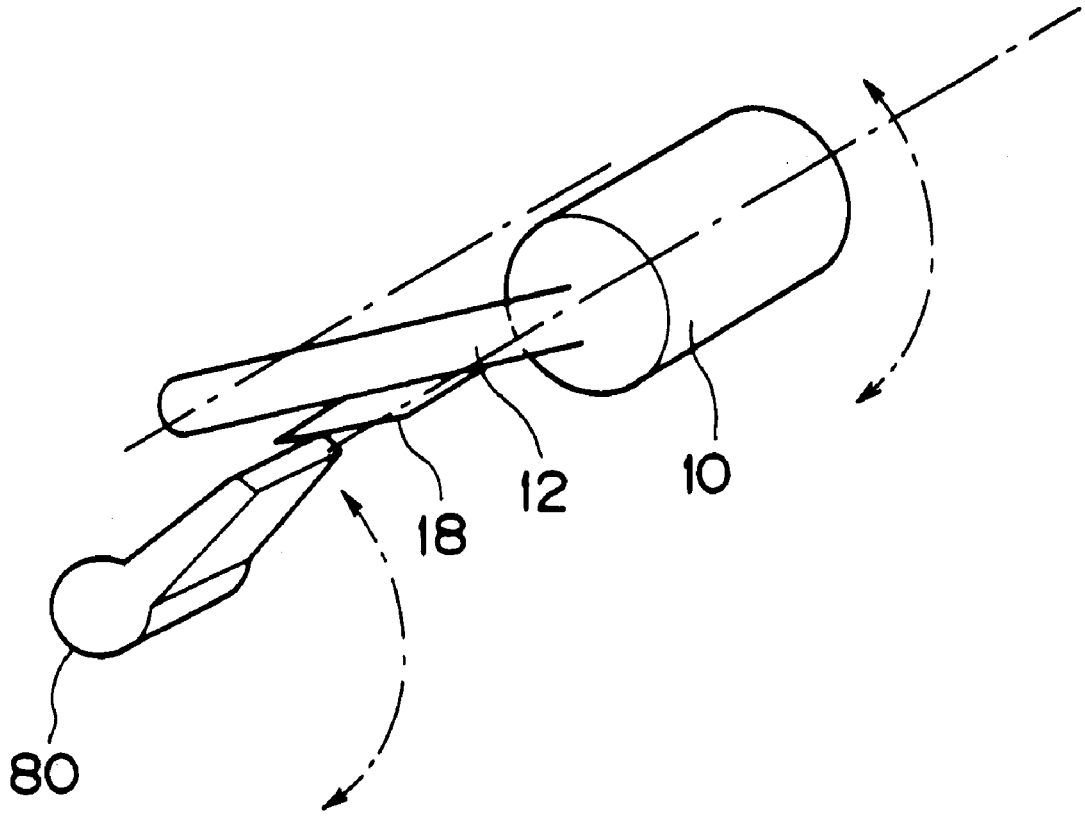
FIG. 5 is a schematic perspective view for explaining an exemplified drive way of the draw roller using a cam.

The draw roller 10 rotates as a result of driving these rods 12 (or a member such as the shaft (not shown) connected to the rod 12). Alternatively, the draw roller 10 may rotate as a result of driving other members connected to the draw roller 10 or rods 12. FIG. 5 shows the latter. Hereupon, FIG. 5 shows an up and down movement method of the draw roller 10 using cam 80.

In this case, the cam 80 that is connected to connection member 18 coupled to the draw roller 10 or rods 12 drives the draw roller 10 via the connection member 18. Of course, the connection member 18 may be provided to the shaft (not shown) between a pair of rods 12. A shape of the connection member 18 is, but not limited to, a plate in FIG. 5. The cam 80 is driven by a drive unit such as a motor (not shown).

In setting sheets P, the draw roller 10 rotates counterclockwise and moves up, for example, by driving the cam 80 counterclockwise in FIG. 5. Usually, such a transmission system would intervene a one-way clutch etc. between the rotational drive source and the draw roller 10 so as to allow a counterclockwise rotation of the draw roller 10.

When a force applied to the cam 80 is released, then the draw roller 10 drops on sheet P's top surface. It might be necessary to connect to the draw roller 10, the rods 12 or another member connected to them a mechanism for pulls the draw roller 10 from the bottom using a spring etc, so as to allow the draw roller 10 to contact the top surface of the sheet P with a predetermined compression force. It might also be necessary to provide a physical limiter that prevents a predetermined rotation of the cam 80 in the longitudinal direction, and a torque limiter etc. that cuts off a power transmission to the cam 80 where more than the predetermined power is applied to the rotational drive source.

The rod 14 is connected at the side of the end 10*b* that is omitted in FIG. 4, to the draw roller 10 or rod 12. The rod 14 is inserted into the horizontal guide groove 72 in the transmission plate 70. When the draw roller 10 is driven up and down, the rod 14 may move along the horizontal guide groove 72. The perpendicular guide groove 74 in the transmission plate 70, into which a pair of rivets 76 are inserted, allows a perpendicular movement of the transmission plate 70. These rivets 76 are connected directly or indirectly to an external frame (not shown), but may be replaced with a rod (not shown) that is inserted into the guide groove 74 in the transmission plate 70 and connected to the external frame (not shown). As mentioned above, the separation gate 30 is fixed onto the transmission plate 70. The rotary action of the draw roller 10 is transmitted to the transmission plate 70 via the rod 14, and moves the transmission plate 70 up and down. As a consequence, the separation gate 30 moves up and down in synchronization with an up-and-down movement of the draw roller 10.

Figure 6:
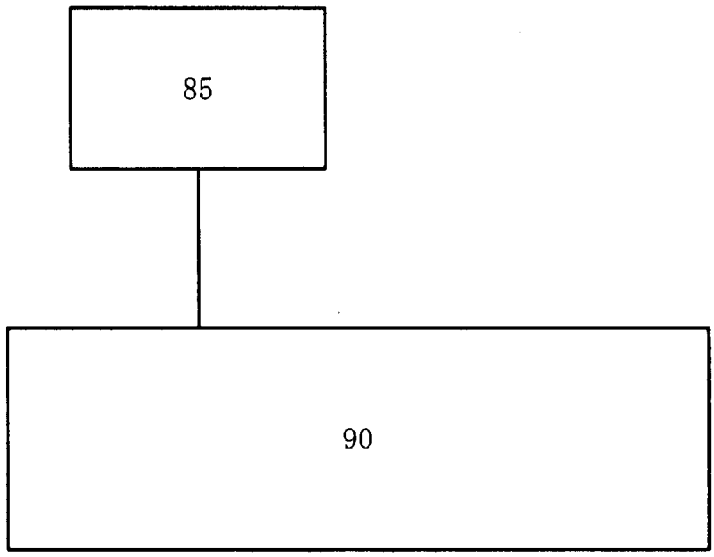
FIG. 6 is a block diagram of a drive control system applicable to the sheet feeder shown in FIGS. 3 through 5.

FIG. 6 shows a control example relating to FIGS. 3 through 5. The drive control system includes pick motor 85 and control part 90. The pick motor 85 is a drive source common to the draw roller 10 and the separation gate 30. The control part 90 controls the pick motor 85. In moving up the draw roller 10, the pick motor 85 is rotated by predetermined steps in a predetermined direction (for example, counterclockwise), whereby the draw roller 10 moves up and stops at a physical limiter position that prohibits its upward movement exceeding the predetermined position. In this state, a user may set a sheet pile LP on the sheet table 28. In response to host's instruction to read sheet P, the control part 90 rotates the pick motor 85 in a direction reverse to the predetermined direction (e.g., clockwise), and moves down the draw roller 10. In addition, it rotates the draw roller 10 in a sheet draw direction (i.e., clockwise in FIG. 1). The rotational timing may occur before and after the draw roller 10 contacts the uppermost sheet P in the pile. As the draw roller 10 moves, the separation gate 30 moves up and down. The draw roller 10 and separation gate 30 may be driven separately by independent drive sources.

Figure 10:
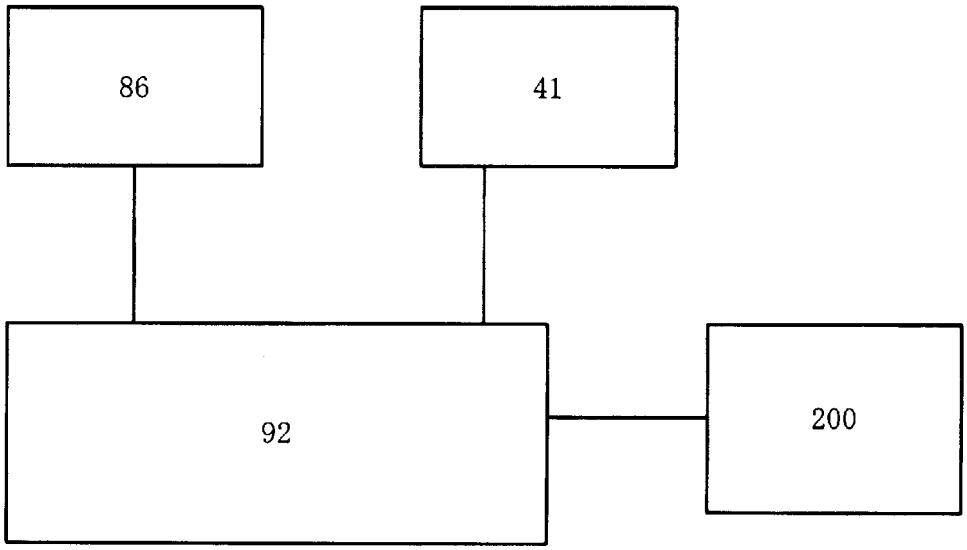
FIG. 10 is a block diagram of a drive control system applicable to the sheet feeder shown in FIGS. 7 through 9.
Figure 7:
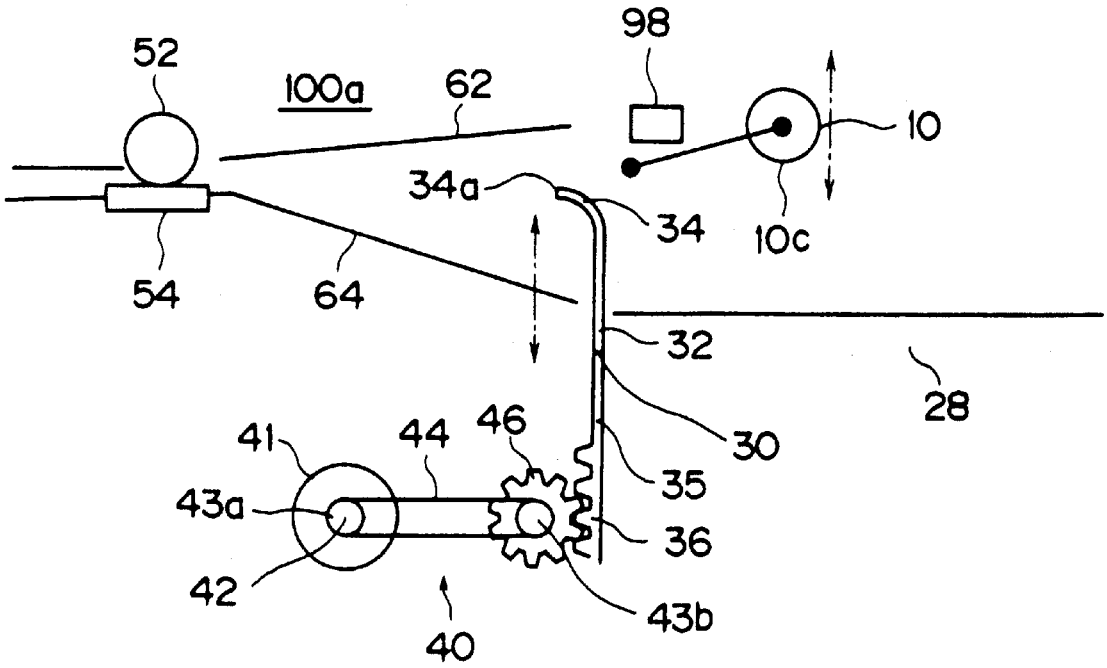
FIG. 7 is a schematic sectional view of the sheet feeder having a drive source for the separation gate independent of the draw roller.
Figure 8:
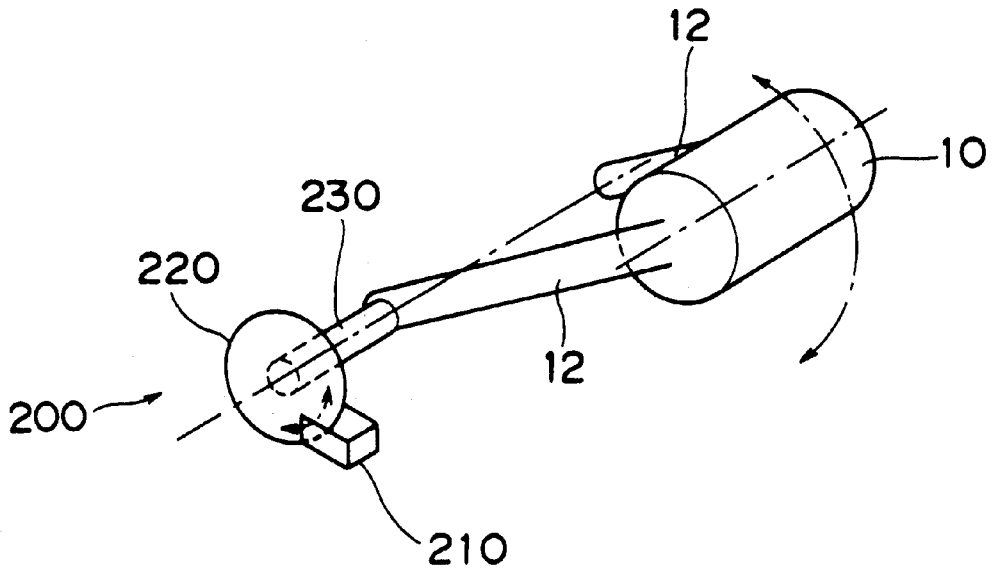
FIG. 8 is a schematic perspective view of a detection system having a sensor and encoder applicable to the sheet feeder shown in FIG. 7.
Figure 9:
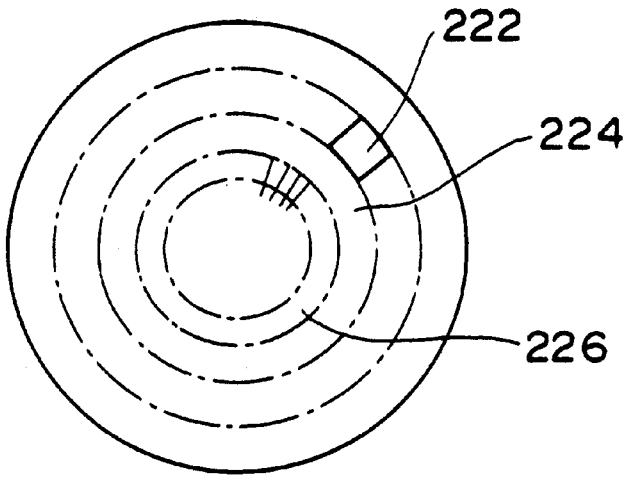
FIG. 9 is a schematic plane view of the encoder shown in FIG. 8.

Next follows a description of such an embodiment with reference to FIGS. 7 through 10. FIG. 7 is a schematic sectional view of the sheet feeder 100*a* having drive source 40 for the separation gate 30. FIG. 8 is a schematic perspective view of detection system 200 having sensor 210 and encoder 220 applicable to the sheet feeder 100*a* shown in FIG. 7. FIG. 9 is a schematic plane view of the encoder 220 shown in FIG. 8. FIG. 10 is a block diagram of a drive control system of the sheet feeder 100*a* shown in FIGS. 7 through 9.

The sheet feeder 100*a* includes rod 35 connected to the separation gate 30. rack 36 formed as a rod, and drive source 40. The drive source 40 includes motor 41, a pair of rollers 43*a* and 43*b*, belt 44, and pinion 46. The roller 43*a* is engaged with motor shaft 42 of the motor 41, and driven by the motor shaft 42. The roller 43*b* is fixed coaxially onto the pinion 46. The belt 44 is spanned around rollers 43*a* and 43*b*, transmitting to the roller 43*b* a drive force applied to the roller 43 by the motor shaft 42. The pinion 46 is engaged with the rack 36, and moves up and down the separation gate 30 connected to the rod 36 and the pinion 46 via the rack 36. Therefore, a control over the drive force by the motor 41 may move up and down the separation gate 30.

The sheet feeder 100*a* includes detection system 200 that detects the height of the draw roller 10 in order to link the action of the draw roller 10 to that of the separation gate 30. The detection system 200 includes sensor 210, encoder 220, and shaft 230. The sensor 210 is comprised of, but not limited to, an optical sensor including light-emitting and light-receiving elements in this embodiment.

The encoder 200 is connected, as shown in FIG. 8, to the shaft 230 and rotates in synchronization with the rotary fulcrum 12*a*. The encoder 220 detects, in cooperation with the sensor 210, the rotary angle of the rotary fulcrum 12*a* and serves to detect the height of the draw roller 10. The encoder 220 includes, as shown in FIG. 9, a plurality of slits including first stage slits 224 that includes slit 222 showing the uppermost position of the draw roller 10, and second stage slits 226 indicating the angle information. These slits may be formed by printing onto a transparent film. Such a structure enables the encoder 220 to detect that the draw roller 10 located at the uppermost position and the rotary angle of the draw roller 10. A beam from the light-emitting element, such as a light-emitting diode, in the sensor 210 is input into the light-receiving element, such as a photo IC, via the slits 222 through 226 in the encoder 220, and converted into a digital signal.

FIG. 10 shows a drive control example relating to FIGS. 7 through 9. The drive control system includes the motor 41, pick motor 86, control part 92, and the detection system 200. The pick motor 86 is a drive source to move up and down the draw roller 10. Unlike FIG. 6, the motor 41 drives the separation gate 30. In other words, the draw roller 10 and the separation gate 30 are separately driven by independent drive sources 86 and 40. The control part 92 is connected to the motors 41 and 86 and the drive system 200, and the control part 92 controls the motors 41 and 86 in accordance with the result detected by the drive system 200.

In moving up the draw roller 10, the pick motor 86 rotates by predetermined steps in a predetermined direction (for example, counterclockwise), whereby the draw roller 10 moves up and stops at a physical limiter position that prohibits its upward movement exceeding the predefined position. In this state, a user may set the sheet pile LP on the sheet table 28. The user may flushes the end of the sheet pile LP with the perpendicular part 32 in the separation gate 30 in setting the pile LP on the sheet table 28, thereby improving the operability in comparison with the conventional set method shown in FIG. 18 causing the scraggy end of the pile LP.

In response to host's instruction to read sheet LP, the control part 92 rotates the pick motor 86 in a direction reverse to the predetermined direction (e.g., clockwise), and moves down the draw roller 10. In addition, it rotates the draw roller 10 in a sheet draw direction (i.e., clockwise in FIG. 1). The rotational timing may occur before and after the draw roller 10 contacts the uppermost sheet P in the pile.

The sensor 210 in the detection system 200 transmits as a digital signal the physical position of the draw roller 10 to the control part 92. The control part 92 controls the motor 41 so that the top part 34*a* of the bent part 34 in the separation gate 30 may be level with or preferably slightly higher than the bottom par 10*c*. As a result, the draw roller 10 and the separation gate 30 are properly arranged in place.

Figure 11:
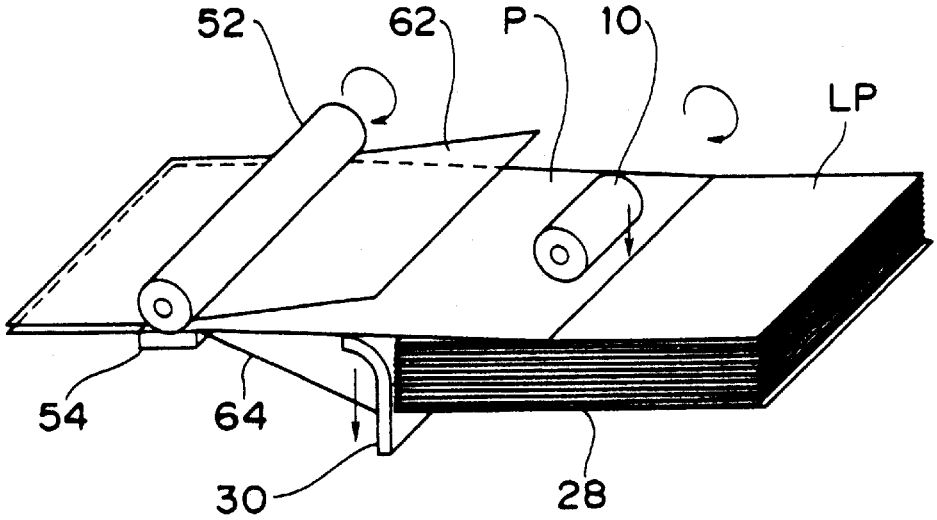
FIG. 11 is a schematic perspective view showing the sheet feeding in the sheet feeder shown in FIG. 1.

A draw action begins when the rotating draw roller 10 contacts the sheet P or the draw roller 10 that has contacted the sheet P rotates, and one or more sheets P at the top of 'the pile LP are fed to the separation gate 30. Since the draw roller 10 and the separation ate 30 are properly positioned, the separation roller 30 allows one or more sheets P to be fed in the feed direction FD. FIG. 11 shows such a state.

Referring to FIG. 11, the draw roller 10 moves down slightly, after feeding the uppermost sheet P, so as to apply a certain force onto and feed the next uppermost sheet P in the pile LP. A control is performed for the draw roller 10 and the separation gate 30 while keeping the relative configuration in which the bottom portion 10*c* of the draw roller 10 may be slightly lower than the top portion 34*a* of the separation gate 30. Preferably, the draw roller 10 has a limiter switch to detect the sheet P (in other words, the draw roller 10 detects its contact with the pile LP). When the switch turns on, the descending action ends. The draw roller 10, which has completed moving down, starts rotating clockwise in FIG. 11, thereby feeding sheet(s) to the separation gate 30. The separation gate 30 serves as an initial stage separator. A higher sheet separation would be obtained by setting the top part 34*a* in the separation gate 30 to the top position of the piled sheets.

Thereafter, the predetermined number of sheets LP that the final separation part 50 may separate is fed to the final separation part 50, thereby causing no jam. The final separation part 50 ejects and feeds only one sheet of sheet P in the feed direction FD using separation roller 352 and separation pad 354. Thus, the sheet feeders 100 and 100*a* of the present invention employ the two-stage sheet separation using the separation gate 30 and final separation part 50 to achieve a high sheet separation performance. The sheet feeders 100 and 100*a* of the present invention thus may supply only one sheet P to the next stage device (such as a scanner) with no double feed and jam.

On the contrary, it would be understood that the conventional sheet feeder 1 shown in FIG. 18 employs one-stage separation mechanism having no separation gate or no member corresponding to the perpendicular part 32 in the separation gate 30, revealing a worse set operability.

Figure 12:
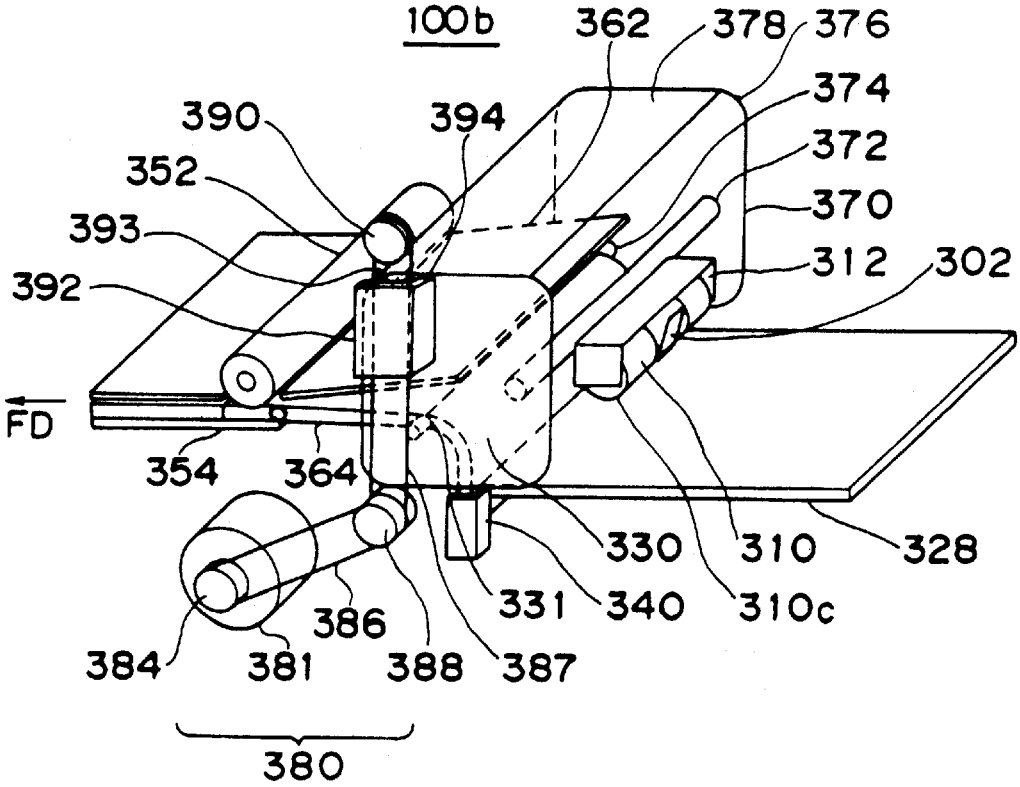
FIG. 12 is a schematic perspective view of a sheet feeder of another embodiment according to the present invention.
Figure 13:
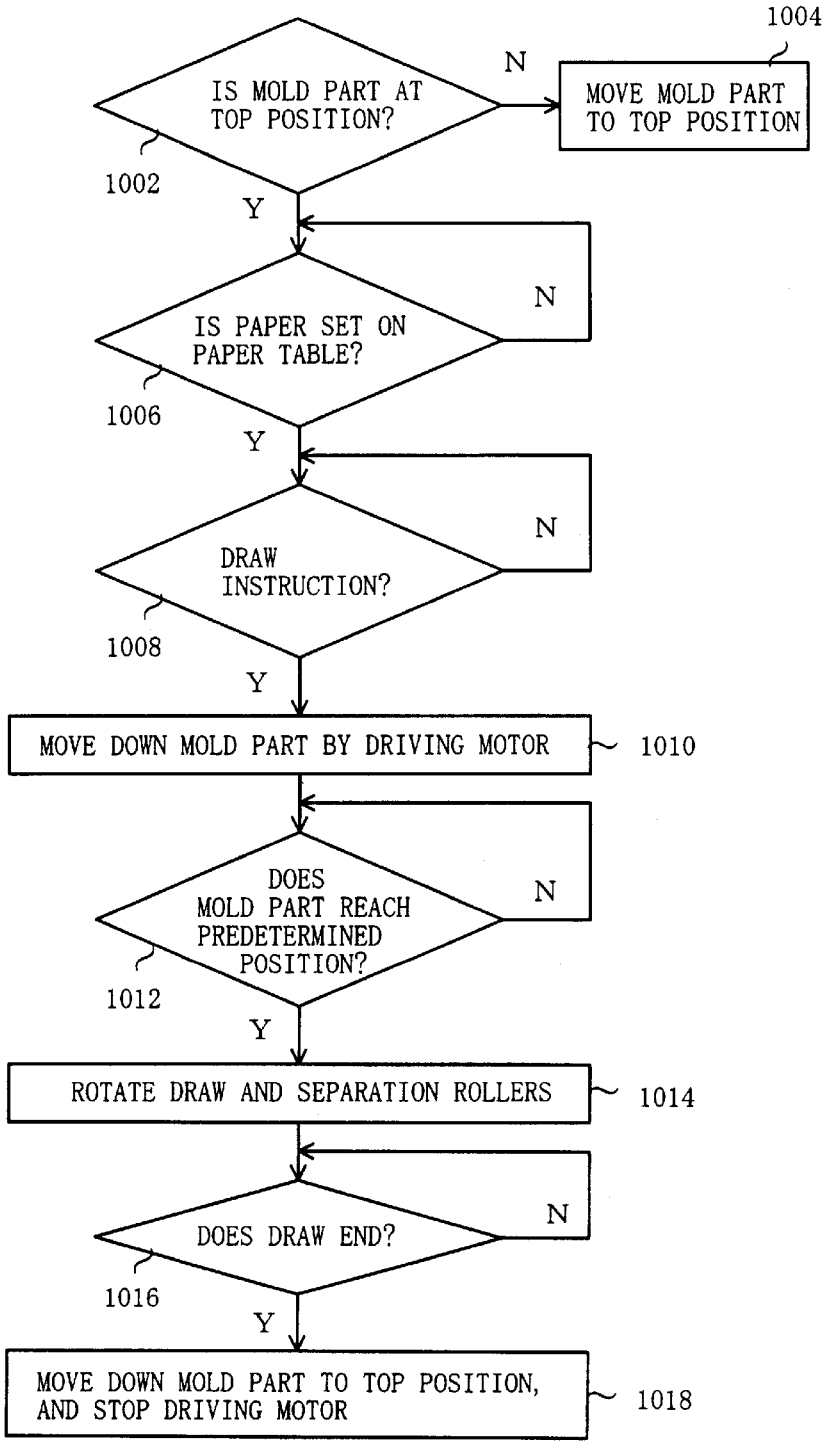
FIG. 13 is a flowchart for explaining a control over up-and-down movement amounts of the draw roller and the separation gate in the sheet feeder shown in FIG. 12.

Next follows a description of the sheet feeder 100*b* of another embodiment according to the present invention, with reference to FIGS. 12 and 13. Hereupon, FIG. 12 is a schematic perspective view of the sheet feeder 100*b*. FIG. 13 is a flowchart for explaining a control over the up-and-down movement amount of each of draw roller 310 and separation gate 330.

Referring to FIG. 12, the sheet feeder 100*b* includes sheet detecting sensor 302, draw roller 310, sheet table 328, separation gate 330, guide 340, separation roller 352, separation pad 354, molding part 370, and drive system 380 for the draw roller 310 and the separation roller 330.

The sheet detecting sensor 302 is comprised, for example, of transmissive or reflective optical sensor which may detect the top of one or more piled sheets LP on the sheet table 328. The sheet table 328 may include a separate sensor that may detect whether the pile LP is placed on the sheet table 328. Such a sensor may be comprised of a pressure sensor which detects sheet P's weight, reflective or transmissive optical sensor, and any other sensor known in the art.

The draw roller 310 includes a pair of rollers, and the sheet detecting sensor 302 is provided between them. The draw roller 310 is substantially the same as the draw roller 10, and a detailed description thereof will be omitted. The draw roller 310 is connected rotatably to shaft 372 that will be described later, via storage cover 312. The storage cover 312 supports a shaft that penetrates a center of the draw roller 310 (not shown).

The separation gate 330 is provided adjacent to the sheet table 328 and movable along the guide 340 in the perpendicular direction. The separation gate 330 is substantially the same as the separation gate 30, and a detailed description thereof will be omitted. The separation sate 330 is connected at its end 331 to the shaft 374 which will be described later. The guide 340 is formed by processing a metal plate, such as stainless as a U shape, and guides the movement direction of the separation gate 330 in the perpendicular direction.

The movements of the draw roller 310 and the separation gate 330 are restricted so that the top of the separation gate 330 is approximately level with the bottom 310*c* ofthe draw roller 310. Preferably they are controlled so that the bottom 310*c* of the draw roller 310 is slightly lower than the top of the separation gate 330.

The separation roller 352 and separation pad 354 constitute the final separation part 350 (not shown). The final separation part 350, separation roller 352, and separation pad 354 correspond respectively to final separation part 50, separation roller 52, and separation pad 54, and a detailed description thereof will be omitted.

The mold part 370 includes a pair of rectangular side plate 376, and top plate 378 that connects tops of the side plates 368 to each other. Shafts 372 and 374 are fixed between these side plates 376. In FIG. 12, the side plate 376 at the front side is connected to the drive system 380. The drive system 380 moves up and down the side plate 376, and thereby moves the draw roller 310 and the separation gate 350.

The drive system 380 includes stepping motor 381, roller 384 fixed onto a motor shaft of the stepping motor 381 rollers 388 and 390 fixed onto an external frame (not shown), belt 386 spanned around the rollers 384 and 388 belt 387 spanned around rollers 388 and 390, and guide 392. The guide 392 is L-shaped, connected to or engaged with the belt 386 at surface 393, and fixed onto the side plate 376 at surface 394. As a consequence, as the drive force of the stepping motor 381 is transmitted to the belt 387 via the rollers 384 and 388 and belt 386, the guide 392 moves up and down with the belt 387. As a result of that the guide 392 moves up and down, the side plate 376 moves up and down, while the draw roller 310 and the separation gate 330 move up and down. The movement amount is controllable using a mechanism similar to the sensor 210 and encoder 220 shown in FIGS. 8 and 9.

A description will now be given of the control method of the movement amount of the mold part 370, with reference to FIG. 13. The drive control system is similar, for example, to the drive control system shown in FIG. 6, and includes control part 400 (not shown) and stepping motor 381.

The instant embodiment moves (returns) the mold part 370 having the draw roller 310 and separation gate 330 to the top position when the previous sheet feeding action ends. Alternatively, the mold part 370 may be moved after the sheet feeding action ends and the power is turned on. Since it is preferable to confirm the position of the mold part 370 even in the former case the control part 400 judges whether the mold part 370 is located at the top position using the sensor and encoder (not shown) (step 1002). The mold part 370 if not located at the top position would reduce the maximum number of sheets to be placed on the sheet table 328. In order to prevent this situation, the control part 400 moves the mold part 370 to the top position (step 1004). These steps 1002 and 1004 arc optional.

When moving the mold part 370 to the top position., the control part 400 rotates the stepping motor 381 counter-clockwise (to the left) in FIG. 12, and moves an engagement side between the belt 387 and the guide 392. As discussed above the top of the mold part 370 is detectable using the sensor 210 and encoder 220 shown in FIGS. 8 and 9. For illustration purposes, these components are omitted in FIG. 12. Alternatively, a physical limiter is provided to prevent an upward movement exceeding the predetermined position and the movement of the draw roller 10 may stop.

As shown in FIG. 7, the step 1002 preferably detects positions of the draw roller 310 and the separation gate 330 and moves their top positions when driving them separately. Such an embodiment is similar to that has been described in detail with reference to FIGS. 7 through 10, and a detailed description thereof will be omitted.

Next, the control part 400 informs a user, when judging that the mold part 370 has moved to the top positions that the sheet P has been ready be set using a lamp, LCD, a voice message, etc. Thereafter, the user sets the pile LP while flushing its end with the separation gate 330 on the sheet table 328. The separation gate 330 has perpendicular part 332 (not shown) similar to the separation gate 30, and facilitates user's set action.

The control part 400 then judges whether the pile LP has been set on the sheet table 328 (step 1006). The control part 400 may judge that the sheet LP has been set, using a sensor (not shown) provided in the sheet table 328. The step 1006 is optional, because an error message indicating no paper set or a paper improperly set where the sheet LP has not been fed the predetermined time after the draw of the sheet P starts. In this case, the control part 400 may provide the above judgment using an optical sensor that may detect the sheet P that passes the feed path, another sensors, and a timer.

When judging that the pile LP has been set on the sheet table 328 and receiving a draw instruction via an interface (not shown) from the host in step 1006, the control part 400 drives the stepping motor 381 and moves down the mold part 370 (step 1010). In this case, the control part 400 rotates the motor 381 clockwise (to the right) in FIG. 12, and moves down the draw roller 310 and separation gate 330 by downwardly moving the engagement side between the belt 387 and the guide 392.

The control part 400 judges whether the mold part 370 has descended to the desired position using a detection by the sheet detecting sensor 302 (step 1012). When the uppermost sheet P of the pile LP contacts the draw roller 310, the sheet detecting sensor 302 turns on and the drive of the motor 381 stops in response to the trigger signal from such a sensor 302.

The control part 400 rotates the draw roller 310 after or while the mold part 370 moves down (step 1014). The control part 400 rotates the separation roller 352 simultaneously (step 1014). The motor 318 or any other drive source may drive and rotate the rollers 310 and 352. The rollers 310 and 352 may be rotationally driven by the separate drive source.

When the rotating draw roller 310 contacts the sheet P, or when the draw roller 310 that contacts the sheet P rotates, the draw action starts and one or more top sheets P in the pile LP are fed to the separation gate 330. As the draw roller 310 and the separation roller 330 are properly positioned, the separation roller 330 allows only one or the predetermined number of sheets P to be fed in the feed direction FD. Then, the sheet P is sent between the upper and lower guides 362 and 364, and then introduced between the separation roller 352 and separation pad 354. Only one sheet P is fed in the direction FD. In the final separation part 350, the separation pad 354 ejects and feeds only one sheet P in the direction FD. As a result, the sheet feeder 100*b* of the present invention may supply only one sheet P to the next stage device (such as a scanner) with no double feed or jam.

The control part 400 judges whether all the sheets are drawn, using a sensor provided in the sheet table 328, a sensor provided in the feed path, and other sensors (step 1016). After the draw action ends, the stepping motor 381 is driven as discussed above, the mold part 370 is moved to the top position, and then the drive of the motor 381 stops (step 1018). As discussed above, it is optional whether the mold part 370 moves to the top position.

The belts 386 and 387 may be replaced with a chain or something. The structure of the drive system 380 is a mere example, and any structure that moves the mold part 370 up and down may be used. As discussed above, the draw roller 301 and the separation gate 330 may be driven by separate drive systems so that the position of the separation gate 330 is controlled in response to the position of the draw roller 310 using a software program.

Figure 14:
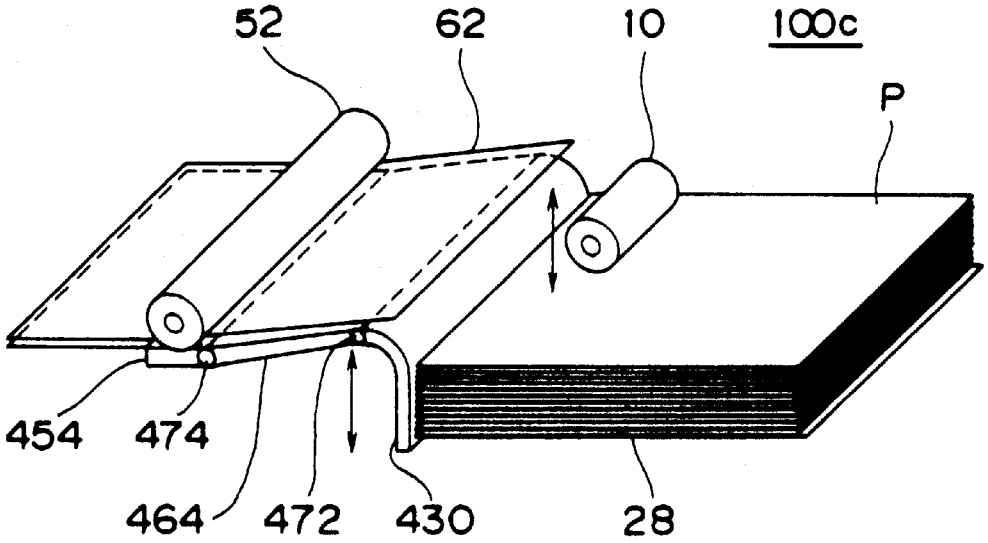
FIG. 14 is a schematic perspective view of a sheet feeder of still another embodiment according to the present invention.
Figure 15:
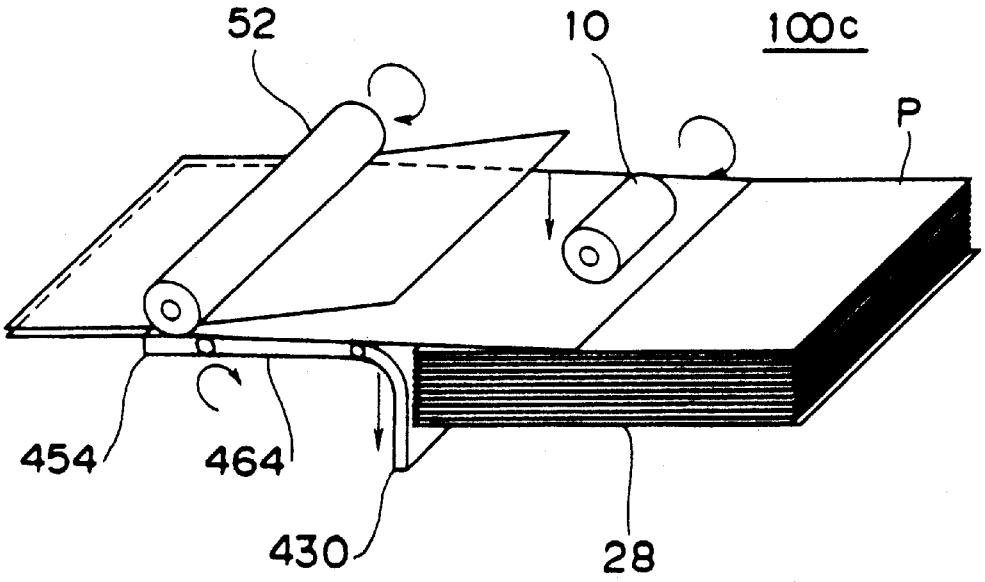
FIG. 15 is a schematic perspective view showing the sheet feeder shown in FIG. 14 feeding a sheet.

Referring to FIGS. 14 and 15, a description will be now given of sheet feeder 100*c* of still another embodiment according to the present invention. Hereupon. FIG. 14 is a schematic perspective view of the sheet feeder 100*c*. FIG. 15 is a schematic perspective view of the sheet feeder 100*c* shown in FIG. 14 feeding a sheet. The sheet feeder 100*c* includes the draw roller 10, the sheet table 28, separation gate 430, separation roller 52, separation pad 454, upper guide 62, and lower guide 464. Therefore, the sheet feeder 100*c* includes characteristically the separation pad 430, the separation pad 454, and the lower guide 464.

The lower guide 464 is connected to the separation gate 430 corresponding to the separation gate 330 via shaft 472 corresponding to the shaft 372, while the separation pad 454 is connected to the shaft 474 corresponding to the shaft 374. On the other hand, the lower guide 364 is not connected to the separation gate 330 in FIG. 12. The lower guide 464 acts in synchronization with the draw roller 10 and the separation gate 430, and thus may prevent the insufficient feed of sheet P that has been separated by the separation gate 430, while the sheet P is fed to the final separation part 450 (not shown) including the separation roller 52 and separation pad 454. For example, the sheet feeder 100*b* shown in FIG. 12 may possibly cause a bad feed due to a downwardly culled sheet P that has passed the separation gate 330, but the present embodiment prevents such a bad feed and improves the sheet feed performance. More specifically, as shown in FIG. 15, the lower guide 464 synchronizes with the draw roller 10 and the separation gate 430, and connects the separation gate 430 to the separation pad 454 straightly, whereby the separated sheet P is fed to the final separation part 450 successfully.

Figure 16:
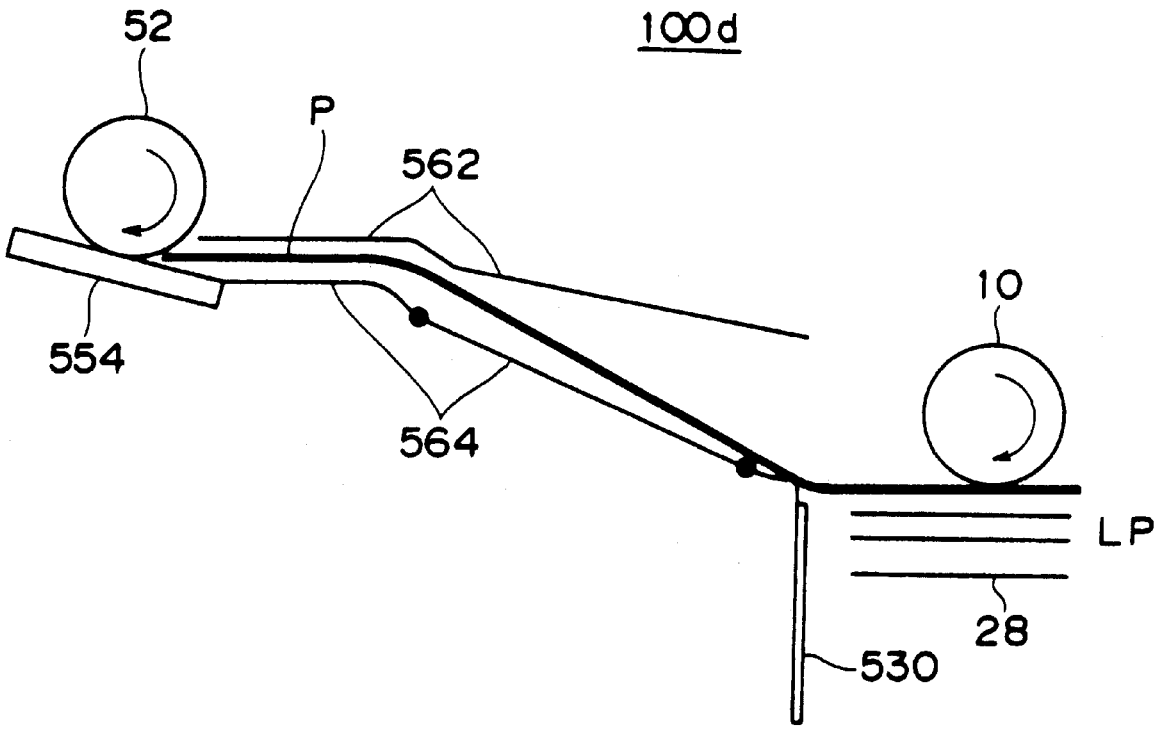
FIG. 16 is a schematic sectional view of a sheet feeder of still another embodiment according to the present invention.

Next follows a description of sheet feeder 100*d* of still another embodiment according to the present invention, with reference to FIG. 16. Hereupon, FIG. 16 is a schematic sectional view of the sheet feeder 100*d*. The sheet feeder 100*d* includes the draw roller 10, the sheet table 28, separation gate 530, the separation roller 52, separation pad 554, upper guide 562, and lower guide 564. The sheet feeder 100*d* of this embodiment prevents a deteriorated sheet separation caused by changes of separation gate 530's upper and lower positions and those of approach angle of the fed sheet P to the final separation part 550 including the separation roller 52 and the separation pad 554. In contrast, in the sheet feeder 100 shown in FIG. 1, the height of the separation gate 30 by the number of sheets P placed on the sheet table 28 changes whereas the height of the final separation part 50 does not change. This causes a problem in that the approach angle of the sheet P to be supplied to the final separation part 50 changes anytime, changing the sheet separation and feed performance.

In order to solve this problem, the sheet feeder 100*d* of the instant embodiment maintain constant sheet's approach angle to the final separation part 550.

In FIG. 16, the upper guide 562 and the lower guide 564 compulsorily bend the sheet P before the sheet P reaches the final separation part 550. The upper and lower guides 562 and 564 are provided between the separation gate 530 and the final separation part 550. The lower guide 564 is coupled between the separation gate 530 and the separation pad 554, and acts in synchronization with the draw roller 10 and the separation gate 530 as in the sheet feeder 100*c* in FIGS. 14 and 15. On the other hand, the upper guide 562 is fixed physically onto an external frame (not shown), and located higher than the maximum sheet height at the separation gate side. The upper and lower guides 562 and 564 may maintain constant sheet's approach angle before the final separation part 550 by compulsorily bending the sheet P even when the sheet's approach angle changes just after the separation gate 530, eliminating a disadvantageous double feeding.

Although the lower guide 564 is coupled to and movable up and down in synchronization with the separation gate 530 in FIG. 16, the upper guide 562 or the upper and lower guides 562 and 564 both may be made synchronously movable alternatively. For example when the upper guide 562 is made movable up and down, the lower guide 564 is arranged to be level with the height of the minimum number of sheets at the separation gate side. When the upper and lower guides 562 and 564 both act, an interval between the lower guide 564 and the upper guide 562 is maintained constant during the sheet feeding period, and much smaller than that where either the upper guide 562 or the lower guide 564 is singularly used.

Although it is conceivable as an alternative embodiment to move up and down the final separation part 550 in synchronization with the up and down movement of the separation gate 530, or rotate the separation pad 50 so that sheet P's approach angle to the separation pad 50 may become constant, either would cause a bulk or complex device.

Figure 17:
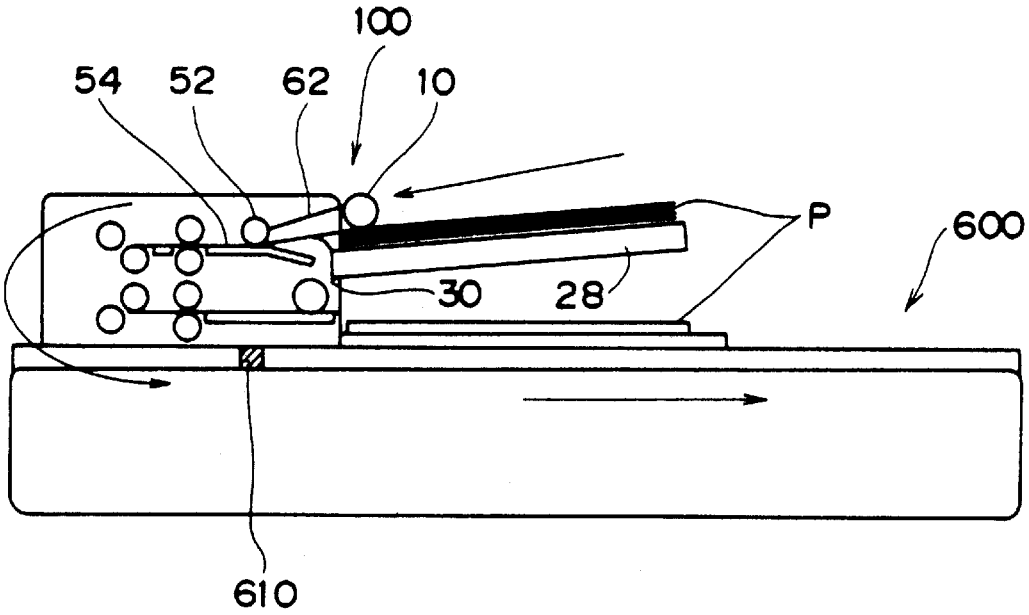
FIG. 17 is a schematic sectional view of an image reader having the sheet feeder of the present invention.

FIG. 17 shows image reader 600 having sheet feeder 100. The sheet feeder 100 generalizes all the variations, such as the sheet feeder 100*a*. As noted the sheet feeder 100 is applicable as an ADF in the image reader 600. Such as a printer, a facsimile machine, a copier, etc. The separation gate 30 and other components may feed a sheet P one by one to the image reader 600. The fed sheet P is red by the reading part 610. The sheet feeder 100 shown in FIG. 17 includes a mechanism for ejecting a read sheet, but such an ejecting mechanism may employ any structure known in the art and a detailed description thereof will be omitted.

Further, the present invention is not limited to these preferred embodiments, but various variations and modifications may be made without departing from the scope of the present invention.

The sheet feeder and image reader of one aspect of the present invention enables two-stage sheet separation using the separation gate and separation roller (and separation pad), and provides a better sheet separation than the conventional sheet feeder having only one-stage separator. The separation gate moving in accordance with the draw roller would provide a stable sheet separation before the separation roller, irrespective of the number of sheets set. The separation gate preferably includes a perpendicular part that may align the end of the pile approximately perpendicular to the feed direction. Thereby, a set of the pile on the sheet feeder is facilitated due to use of flushing with the separation gate. The guide part maintains constant sheet's approach angel to the separation roller, and improves the sheet separation performance by preventing a change in the sheet separation condition.

According to the sheet feeding method of another aspect of the present invention a relative arrangement between the separation gate and the draw roller is made adjustable so as to form an optimal arrangement between them suitable for separation purposes, providing a sheet feed action with a good sheet separation performance.

What is claimed is:

1. A sheet feeder comprising:

a draw roller movably provided so that said draw roller may contact an uppermost sheet in plural sheets, and feeding one sheet or more including the uppermost sheet;

a separation gate provided downstream relative to said draw roller in a sheet feed direction, said separation gate restricting the number of sheets fed by said draw roller; and a transmission mechanism which moves said separation gate in synchronization with a movement of said draw roller.

2. A sheet feeder according to claim 1, further comprising a positioning device which sets a top of said separation gate to be higher than a bottom of said draw roller.

3. A sheet feeder according to claim 1 further comprising:

a separation pad which serves to separate the uppermost sheet from those fed by said draw roller; and a pad mover which moves said separation pad according to a movement of said separation gate.

4. A sheet feeder according to claim 1, wherein said separation gate includes:

a perpendicular part which is approximately perpendicular to the sheet feed direction and blocks a feed of the sheet; and a bent part connected to said perpendicular part, said bent part bending in the sheet feed direction and allowing the sheet to be fed.

5. A sheet feeder comprising:

a draw roller movably provided so that said draw roller may contact an uppermost sheet in a pile of sheets, and feeding one sheet or more including the uppermost sheet; and a separation gate provided downstream relative to said draw roller in a sheet feed direction, and aligning an edge of the pile with a direction approximately perpendicular to the sheet feed direction.

6. A sheet feeder comprising:

a draw roller provided movably up-and-down so that said draw roller may contact an uppermost sheet in plural sheets, and feeding one sheet or more including the uppermost sheet;

a separation roller which separates the uppermost sheet from those fed by said draw roller and feeds the uppermost sheet;

a separation pad which cooperates with said separation roller; and a guide part which contacts the sheet fed by said separation roller, and maintains an approach angle of the sheet to said separation roller.

7. A sheet feeder according to claim 6, wherein said guide part includes a guide member which contacts a top surface of the sheet fed and restricts an upward movement of the sheet.

8. A sheet feeder according to claim 6, further comprising:

a separation gate provided between said draw roller and said separation roller, said separation gate restricting the number of sheets fed by said draw roller to said separation roller;

a transmission mechanism which moves said separation gate in synchronization with a movement of said draw roller; and a guide part including a guide member connected rotatably to said separation gate, said guide member rotating according to a movement of said separation gate, contacting a rear surface of the sheet, and restricting a downward movement of the sheet.

9. A sheet feeder according to claim 6, wherein said guide part includes a guide member connected rotatably to said separation pad, said guide member rotating according to a movement of said separation gate, contacting a rear surface of the sheet, and restricting an downward movement of the sheet.

10. A sheet feeder comprising:

a draw roller provided movably up-and-down so that said draw roller may contact an uppermost sheet in plural sheets, and feeding one sheet or more including the uppermost sheet;

a separation roller which separates the uppermost sheet from those fed by said draw roller, and feeds the uppermost sheet;

a separation pad which cooperates with said separation roller; and a separation gate provided between said draw roller and said separation roller, and restricting the number of sheets fed by said draw roller feeds to said separation roller.

11. A sheet feeding method comprising the steps of:

sequentially feeding one or more sheets from a top of piled sheets placed on a table using a draw roller;

restricting, using a separating gate, the number of sheets to be fed;

adjusting a relative configuration between the separation gate and the draw roller; and separating using a separation pad and a separation roller, a sheet out of those fed through the separation gate.

12. A method according to claim 11 further comprising a step of setting a top of the separation gate to be higher than a bottom of the draw roller.

13. An image reader comprising:

a sheet feeder; and a reading part which reads out a sheet fed by said sheet feeder, wherein said sheet feeder comprises:

a draw roller movably provided so that said draw roller may contact an uppermost sheet in plural sheets, and feeding one sheet or more including the uppermost sheet;

a separation gate provided downstream relative to said draw roller in a sheet feed direction, and movable according to a movement of said draw roller, said separation gate restricting the number of sheets fed by said draw roller; and a transmission mechanism which moves said separation gate in synchronization with a movement of said draw roller.

14. An image reader comprising a sheet feeder; and a reading part which reads out a sheet fed by said sheet feeder, wherein said sheet feeder comprises:

a draw roller movably provided so that said draw roller may contact an uppermost sheet in plural sheets, and feeding one sheet or more including the uppermost sheet; and a separation gate provided downstream relative to said draw roller in a sheet feed direction and aligning an edge of the pile with a direction approximately perpendicular to the sheet feed direction.

15. An image reader comprising:

a sheet feeder; and a reading part which reads out a sheet fed by said sheet feeder, wherein said sheet feeder comprises:

a draw roller provided movably up-and-down so that said draw roller may contact an uppermost sheet in plural sheets, and feeding one sheet or more including the uppermost sheet;

a separation roller which separates the uppermost sheet from those fed by said draw roller and feeds the uppermost sheet;

a separation pad which cooperates with said separation roller; and a guide part which contacts the sheet fed by said separation roller and maintains an approach angle of the sheet to said separation roller.

16. An image reader comprising:

a sheet feeder; and a reading part which reads out a sheet fed by said sheet feeder, wherein said sheet feeder comprises:

a draw roller provided movably up-and-down so that said draw roller may contact an uppermost sheet in plural sheets, and feeding one sheet or more including the uppermost sheet;

a separation roller which separates the uppermost sheet from those fed by said draw roller and feeds the uppermost sheet;

a separation pad which cooperates with said separation roller; and a separation date provided between said draw roller and said separation roller, and restricting the number of sheets fed by said draw roller feeds to said separation roller.

* * * * *